United States Patent [19]

Haug

[11] 3,940,100

[45] Feb. 24, 1976

[54] MODULAR CONSTRUCTION ELEMENT

[76] Inventor: Merrill W. Haug, 815 O'Farrell St., San Francisco, Calif. 94109

[22] Filed: Oct. 29, 1974

[21] Appl. No.: 518,344

[52] U.S. Cl. ..... 248/188.1; 46/30; 248/165

[51] Int. Cl.[2] ..... F16M 11/20

[58] Field of Search..... 248/188.1, 165, 346; 46/16, 17, 21, 22, 23, 30, 25; D6/85, 145; D19/61; D30/10; 52/DIG. 10

[56] References Cited

UNITED STATES PATENTS

| | | | |
|---|---|---|---|
| 2,902,821 | 9/1959 | Kelly | 46/30 |
| 3,310,906 | 3/1967 | Glukes | 46/17 |
| 3,537,706 | 11/1970 | Heavener | 46/30 |
| 3,564,758 | 2/1971 | Willis | 46/25 |
| 3,698,124 | 10/1972 | Reitzal et al. | 46/30 |
| D74,395 | 2/1928 | Silberhartz | D30/10 |
| D111,853 | 10/1938 | Johnson | D19/61 |
| D212,267 | 9/1968 | Dreyfuss | D6/145 |

*Primary Examiner*—William H. Schultz
*Assistant Examiner*—Robert A. Hafer
*Attorney, Agent, or Firm*—Limbach, Limbach & Sutton

[57] ABSTRACT

A modular element for constructing furniture or artistic sculptures comprising a flat member having three equilaterally arranged legs and three equilaterally arranged, arc-shaped sides having equal radii of curvature, each of the legs having a slot extending through its thickness and arranged equilaterally with the slots in the other legs. Groups of four elements are assembled with a center element being engaged at each of its slotted legs with a separate slotted leg of one of the other elements. In one preferred embodiment a group of twenty such elements are so assembled to form an artistic sculpture.

4 Claims, 10 Drawing Figures

MODULAR CONSTRUCTION ELEMENT

BACKGROUND OF THE INVENTION

The present invention relates to a modular construction element and, more particularly, to a flat construction element for use in making furniture or artistic sculptures.

Flat, modular elements have long been used in making children's toys and such elements are often made of thin, flexible materials which are deformable. Furthermore, such elements sometimes have straight sides which do not combine together to form a plurality of curved lines and surfaces which give an artistic appearance and functional advantage.

The advantage of a modular construction for furniture is that the elements may be shipped flat in disassembled form to the end user, who can then simply fit them together to create a piece of furniture. If the elements are designed to be combined in a plurality of different modes the end user has the option of creating different artistic effects as well as different furniture forms. One problem in all such modular furniture constructions is in achieving a sturdy assembled structure with elements which can be both easily assembled and disassembled.

SUMMARY OF THE INVENTION

The above objectives are obtained and the problems of prior art structures are overcome by the present invention of a modular construction element comprising a flat member having three equilaterally arranged legs and three equilaterally arranged, arc-shaped sides having equal radii of curvature, each of the legs having an open ended slot extending through its thickness, oriented toward the centroid of the element, and arranged equilaterally with the slots in the other legs. These elements may be combined in groups of four with at least one of the elements having the slot in each of its legs interlocked with the slot in one leg of a separate one of the other three elements to form a sturdy structure having one horizontal element and three vertical elements, for example.

In some preferred embodiments a plurality of such four element groups are combined so that each of the other three elements in each group has a slot in one of its other legs interlocked with the slot in the other leg of one of the other three elements of another group. The maximum number of elements which can be assembled symmetrically in such a combination is twenty. This limit is a function of the inherent geometry of the element's construction. Thereafter, the design merely repeats itself.

Because of the arcuately shaped edges of each element the overall construction has certain advantages that other modular constructions do not have. One such advantage is that the basic construction of four elements will securely seat a sphere-shaped object or other rounded type objects. In the maximum symmetrical combination of twenty such elements they will define a hollow, sphere-shaped space which may contain, for example, a plastic sphere globe lamp, decorative item, or other functional shapes such as a planter or fireplace base.

The slots in each leg of each element serve a dual purpose. In addition to providing an interlocking mechanism for each of the modules, they also secure various accessories to the base, such as beveled leg assemblies which provide a stable base for an assembly of four or more such units and which also can serve as table top holders. Each element is made of a substantially rigid, nonflexible material. In a preferred embodiment, the material chosen is a plywood or other hard wood, which is approximately one-fourth to one and one-half inches thick.

In one preferred embodiment, the elements are stackable for shipping by overlaying them one on top of another and providing an interlocking member which is wedged into the slots of the stacked elements to hold them in place.

It is therefore an object of the present invention to provide a modular construction element which is flat and which may be assembled with three other such elements to form a three-legged, stable base for supporting both sphere-shaped and plane-shaped objects.

It is another object of the invention to provide a three-legged constructional element which may be assembled in groups of four or more such elements together to form an artistic work.

The foregoing and other objectives, features and advantages of the invention will be more readily understood upon consideration of the following detailed description of certain preferred embodiments of the invention, taken in conjunction with the accompanying drawings.

DETAILED DESCRIPTION OF CERTAIN PREFERRED EMBODIMENTS

Figure 1:
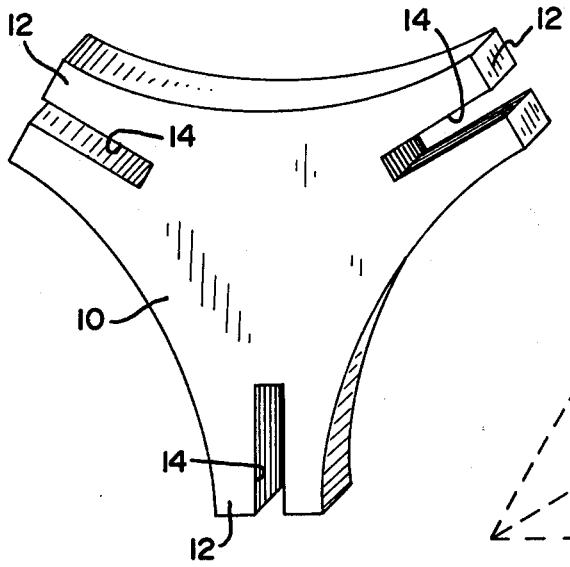
FIG. 1 is a perspective view of the basic, modular construction element according to the invention.

Referring now more particularly to FIG. 1, a flat, rigid element 10 according to the invention is depicted which has three equilaterally spaced legs 12. Each leg has a rectangularly shaped, open ended slot 14 through its thickness and oriented axially toward the centroid of the triangularly shaped element 10. Each of the three slots 14 is also equilaterally arranged with respect to the other slots. Thus, each of the legs 12 and each of the slots 14 is oriented at 120° with respect to the other legs and slots, respectively. The sides 16 of each element 10 between each leg 12 are arc-shaped and have the same radius of curvature.

The element 10 is made of a rigid material, such as wood or plastic, and can be any thickness desired although in the preferred embodiment, the thickness range is from one-fourth of an inch to one and one-half inches. the width of the slot 14 should be only slightly greater than the thickness of the element 10 so that when an element leg 12 is inserted into the slot 14 it will fit snugly. The axial length of the slots 14 is a matter of design criteria, but it should be sufficient to provide a rigid, interlocking mechanism when assembled with the other elements as depicted in FIG. 3.

Figure 3:
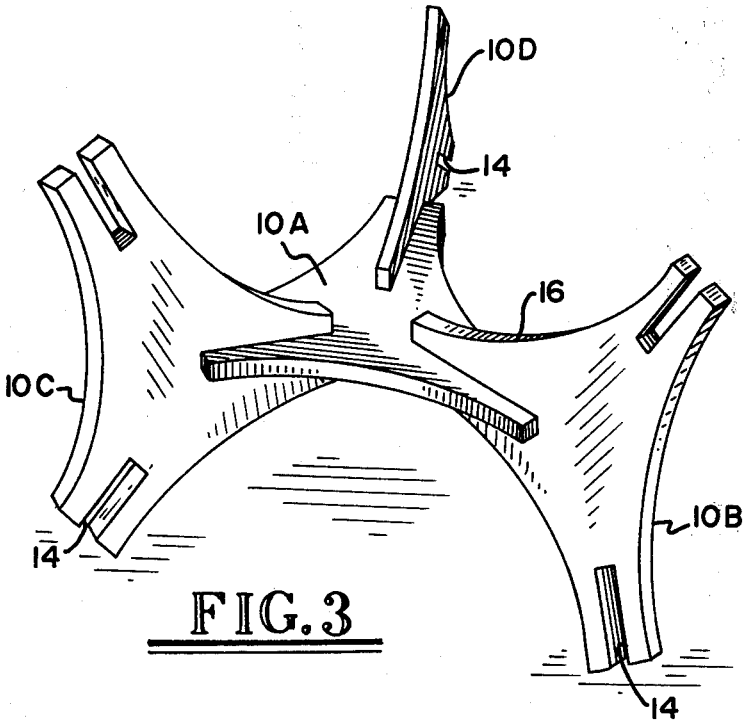
FIG. 3 is a perspective view of a group of four such elements as depicted in FIG. 1 when joined together according to the invention.

Referring now more particularly to FIG. 3, an assembly of four of the units 10 is depicted in which a center element 10*a* is horizontal and is interlocked along each of its slots 14 with corresponding slots 14 in each of three other, vertical elements 10*b*, 10*c* and 10*d*. When interlocked in this manner, the group of four elements provides a sturdy, three-legged structure which will support either a flat surface on the uppermost legs 12 of the elements 10*b*, 10*c* and 10*d* or a sphere-shaped object in the uppermost curved sides 16 of each of the upstanding elements 10*b*, 10*c* and 10*d*. The elements 10*a*, 10*b*, 10*c* and 10*d* are easily assembled into this basic structure without the need to use glue or fastening devices. The structure can also be easily disassembled for shipping or storage.

Figure 4:
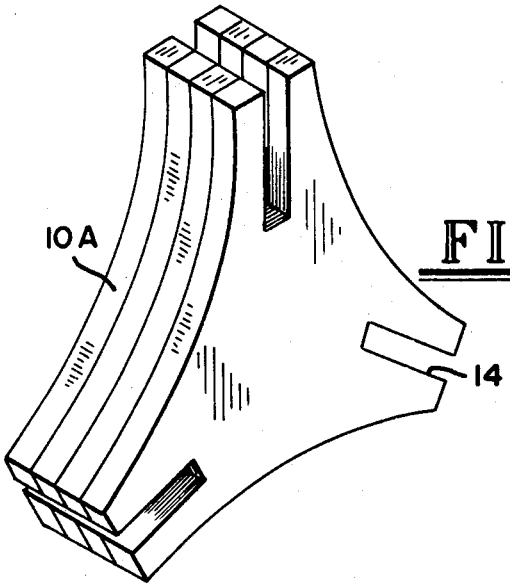
FIG. 4 is a perspective view of four of the elements depicted in FIG. 1 when stacked together for shipping.

Referring now more particularly to FIG. 4, it can be seen that each of the elements 10 depicted in FIG. 3 may be overlaid or stacked flat, one on top of another, for ease in shipping or storage and the thus assembled group may be held in this arrangement by placing wedges (not shown) into the corresponding slots 14 of the elements 10.

Figure 2:
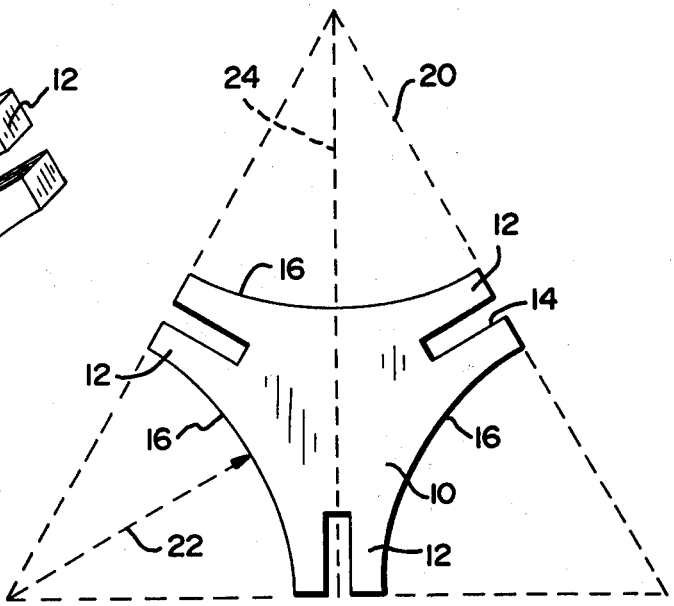
FIG. 2 is a diagrammatic illustration of the geometric construction of the element depicted in FIG. 1.

Referring now more particularly to FIG. 2, the geometrical construction of the element 10 is illustrated. The element 10 is constructed within the perimeter of a hypothetical, equilateral triangle 20. As described above, each of the element sides 16 between the legs 12 is arc-shaped and has a radius of curvature 22, from a corresponding, opposite vertice of the equilateral triangle 20, which is equal to the radius of curvature of each of the other sides 16. The axial center line or axis of symmetry of each leg 12 lies along individual, corresponding hypothetical lines 24 which intersect the midpoint of one of the sides of the triangle 20 and the opposite vertex. While only one radius 22 and one midline 24 are shown in FIG. 2 for purposes of clairty in the illustration, it will be understood that other corresponding radii and midlines 22 and 24, respectively, can be similarly constructed for the other sides 16 and the legs 12. It is this fundamental geometry of the element 10 which enables it to combine to form the shapes depicted in FIGS. 1 and 3 and in the shape to be described in FIG. 7.

Figure 5:
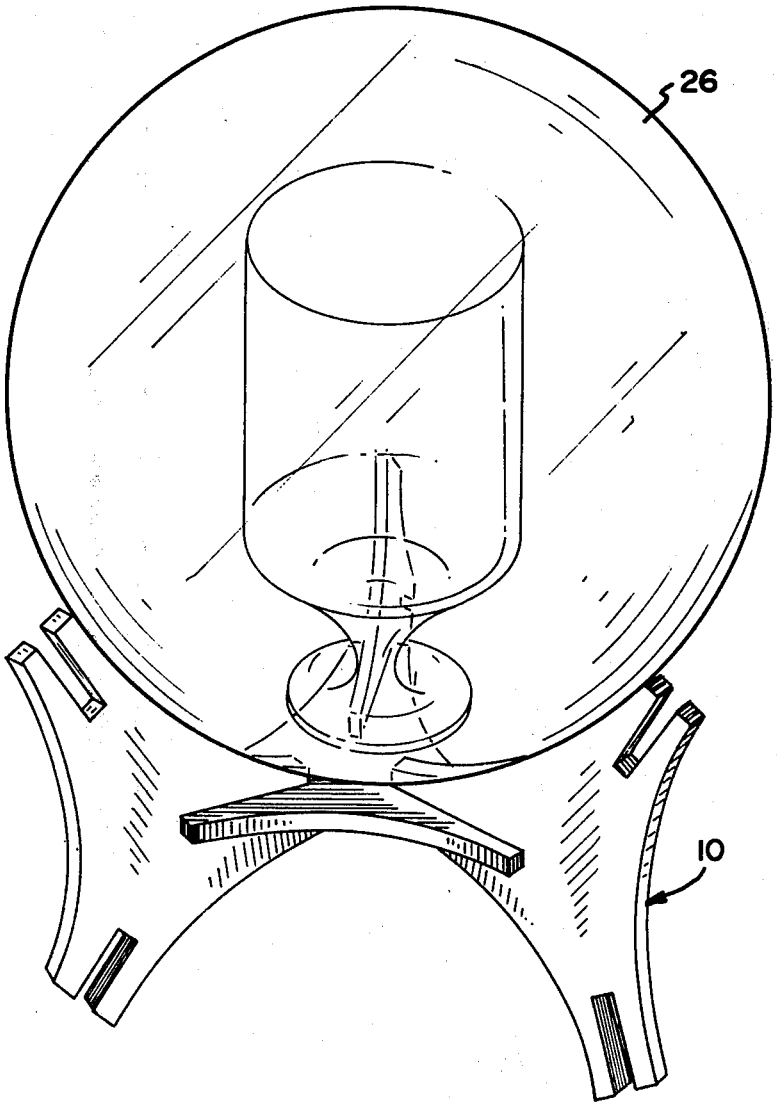
FIG. 5 is a perspective view illustrating a typical use of a group of four such elements as depicted in FIG. 3 in combination with an artistic, sphere-shaped object.
Figure 6:
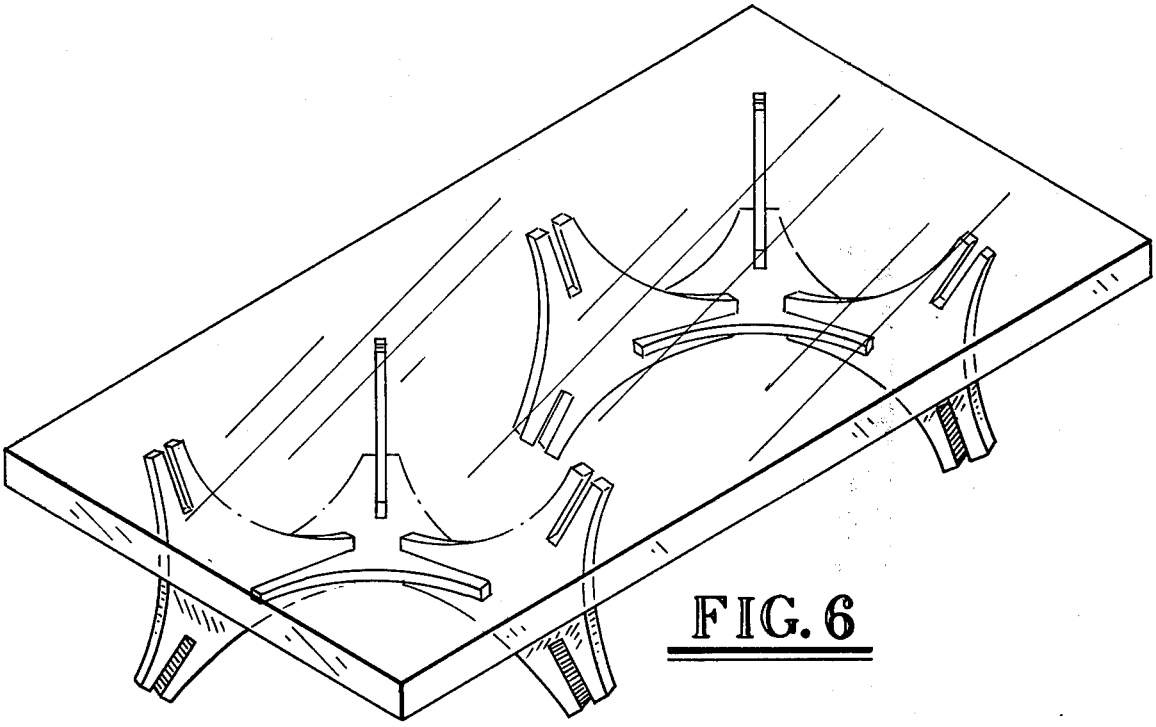
FIG. 6 is a perspective view illustrating a typical use of two groups of four such elements as depicted in FIG. 3 for supporting a table top.

Referring now more particularly to FIGS. 5 and 6, typical uses for the assembly of four elements depicted in FIG. 3 are illustrated. In FIG. 5 a sphere-shaped, artistic object 26 is supported along the upper curved surfaces 16 of an assembly of four of the elements 10. The sphere-shaped object 26 need not be a complete sphere. It could also be bowl-shaped, such as for a barbecue pit or a modern open-hearth stove. As illustrated in FIG. 6, two or more of the four element groups may be used to support a flat plane surface, such as a table top 28.

Figure 7:
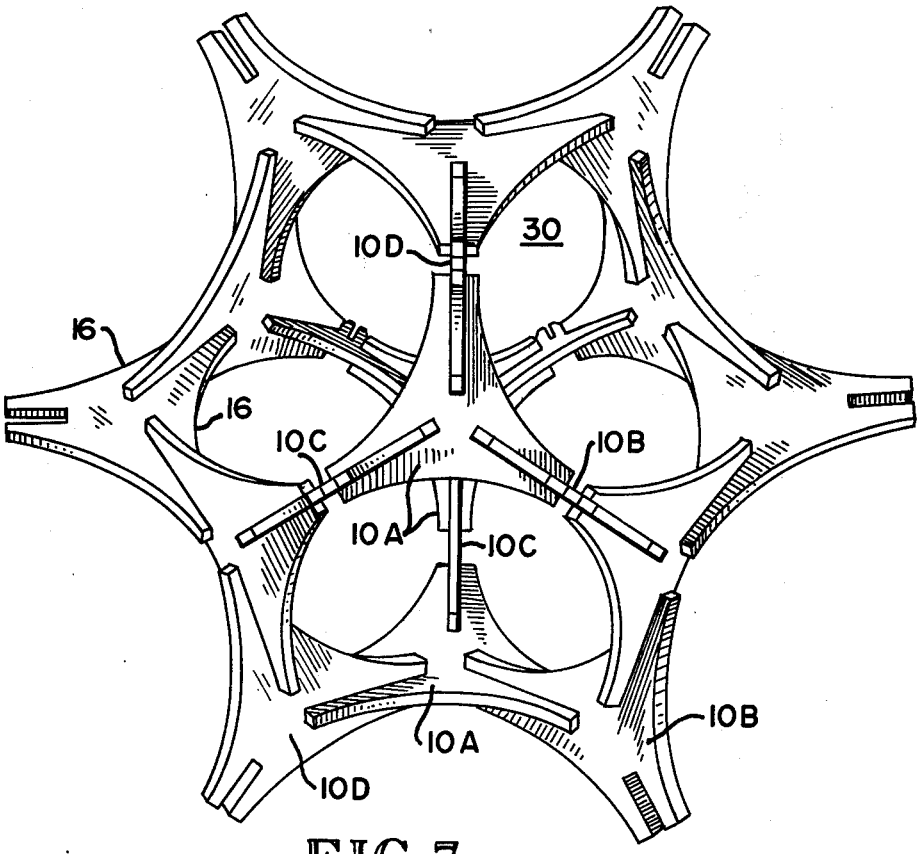
FIG. 7 is a perspective view of a plurality of the elements depicted in FIG. 1 when assembled into an artistic structure having an interior, sphere-shaped, hollow space.

Referring now more particularly to FIG. 7, an artistic sculpture made of a plurality of four element groups is illustrated in which each of the elements 10*b*, 10*c* and 10*d* has a slot in one of its other legs interlocked with the slot in the other leg of another one of the three elements in another four-element group. The interior curved sides 16 of the combined elements together define a sphere-shaped, hollow space 30 which may be left empty or which may be filled with a sphere-shaped, artistic or ornamental object.

Figure 8:
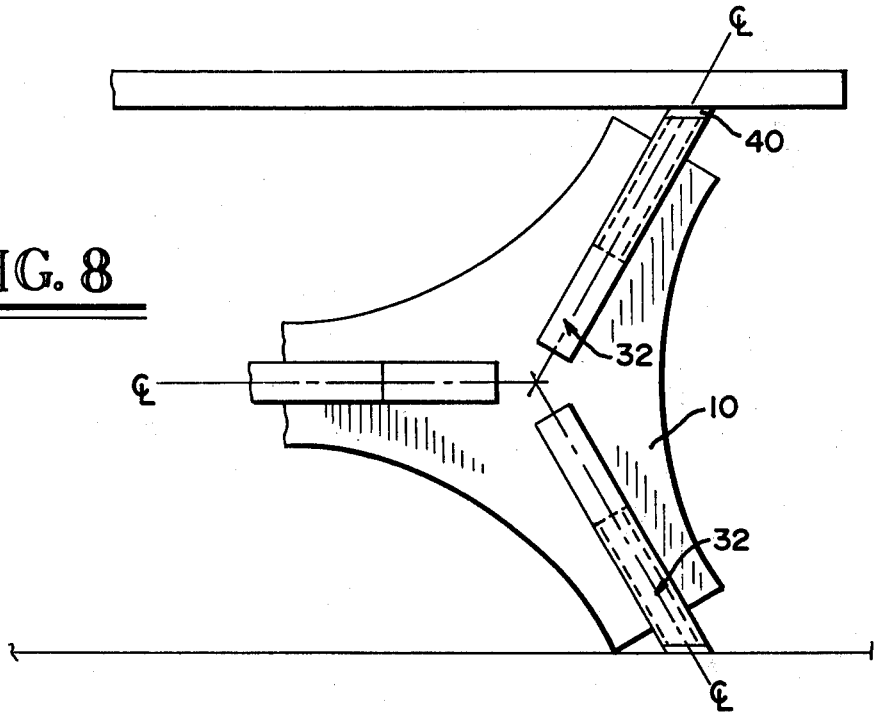
FIG. 8 is a side view, in elevation, and with portions broken away, of the four element group depicted in FIG. 3 together with a plane surface and a leg and holder assembly.
Figure 9:
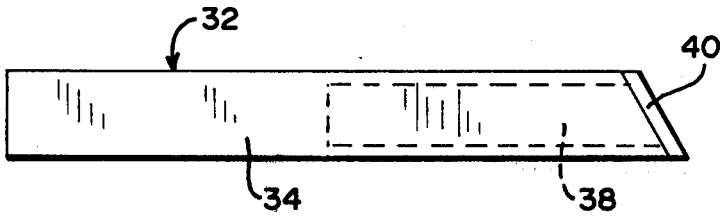
FIG. 9 is an enlarged side view of the leg and holder assembly depicted in FIG. 8.
Figure 10:
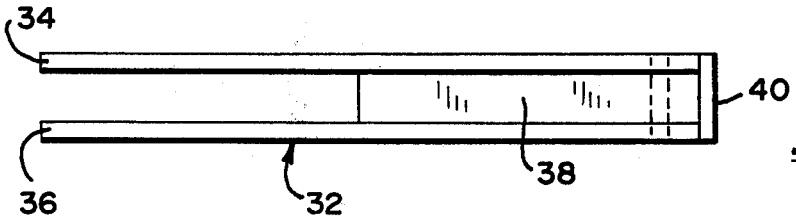
FIG. 10 is an enlarged plan view of the leg and holder assembly depicted in FIG. 9.

Referring now more particularly to FIGS. 8, 9 and 10, a combination leg and plane surface holder assembly 32 for use with a group of four elements is depicted as comprising a pair of spaced apart, rigid, parallel strips 34 which are joined together at one end by an intermediate, rectangular cross-shape member 38. The strips 34 and the member 38 are beveled at one end and fitted with a non-skid surface 40, such as a rubber pad, for example. The member 38 is thinner than the width of the strips 34 and is nearly the same in thickness as the width of the notches 14 in the member legs 12.

The assembly 32 can thus be fitted into the notch 14 of a member leg 12 so that the member 38 is engaged in the notch 14 and the spaced apart ends of the strips 34 which are distal from the member 38 overlap the flat sides of the member 10 towards its center (see FIG. 8) to hold the assembly 32 in rigid engagement with the member 10. The angle of the bevel in the end is such that the non-skid surface 40 is substantially horizontal when the assembly 32 is engaged in the legs 12 of the modular elements 10 fitted together in four element groups. This feature provides a stable, horizontal foot base for the four element groups and a stable, horizontal support for a table top, as shown in FIG. 8.

While certain uses have been depicted for the elements of the invention, it should be apparent that numerous other combinations will be clear to those skilled in the art upon reading the foregoing specification.

The terms and expressions which have been employed here are used as terms of description and not of limitations, and there is no intention, in the use of such terms and expressions, of excluding equivalents of the features shown and described, or portions thereof, it being recognized that various modifications are possible within the scope of the invention claimed.

What is claimed is:

1. In combination, a group of four inflexible, modular construction elements, each element being flat and having three equilaterally spaced legs with arc-shaped sides between each leg, each of the arc-shaped sides having the same radius of curvature, each of the legs further having a slot through its thickness which extends toward the centroid of the element, the width of the slots being only slightly greater than the thickness of the element, and at least one of the elements having the slot in each of its legs fully inserted in the slot in one leg of a separate one of the other three elements so that one element is oriented perpendicularly to the other three elements and is inflexibly interloced therewith to form a rigid, load bearing structure whose constituent elements are inflexible with respect to each other when so interlocked.

2. A combination as recited in claim 1 further comprising a plurality of such four element groups, each of the other three elements in each group having a slot in one of its other legs interlocked with the slot in the other leg of one of the other three elements of another group.

3. A combination as recited in claim 2 wherein there are maximum of twenty interlocked elements.

4. A modular construction element comprising a flat member having three equilaterally spaced legs with arc-shaped sides between each leg, each of the arc-shaped sides having the same radius of curvature, each of the legs further having a slot through its thickness which extends toward the centroid of the element, the width of the slot being only slightly greater than the thickness of the element and further including a leg and holder assembly having a pair of parallel strips and a rectangularly shaped member mounted between and to the strips at one end to space them apart, the strips and the rectangular member being beveled at one end, the strips being wider than the width of the leg slots, and the rectangular member being thinner than the width of the leg slots so that the leg and holder assembly can be fitted to an element leg by engaging the rectangular member in the leg slot with the strips overlying opposite sides of the element leg.

* * * * *